US005769650A

United States Patent [19]

Aoyama et al.

[11] Patent Number: 5,769,650

[45] Date of Patent: Jun. 23, 1998

[54] CONNECTOR AND COVER THEREFOR

[75] Inventors: Masahiko Aoyama; Keigo Atsumi, both of Yokkaichi, Japan

[73] Assignee: Sumitomo Wiring Systems, Ltd., Japan

[21] Appl. No.: 663,639

[22] Filed: Jun. 14, 1996

[30] Foreign Application Priority Data

Jun. 19, 1995 [JP] Japan ..... 7-176826

[51] Int. Cl.[6] ..... H01R 29/00

[52] U.S. Cl. ..... 439/189; 439/357

[58] Field of Search ..... 439/189, 357, 439/358, 353, 490, 350, 595, 509, 511, 597, 598, 599

[56] References Cited

U.S. PATENT DOCUMENTS

| | | | |
|---|---|---|---|
| 4,708,662 | 11/1987 | Klein . | |
| 4,915,648 | 4/1990 | Takase et al. | 439/490 OR |
| 5,015,199 | 5/1991 | Hirano et al. | 439/353 OR |
| 5,462,450 | 10/1995 | Kodama | 439/357 X |

FOREIGN PATENT DOCUMENTS

| | | |
|---|---|---|
| 64-36986 | 3/1989 | Japan . |
| 7-22056 | 5/1995 | Japan . |

*Primary Examiner*—Neil Abrams
*Assistant Examiner*—Daniel Wittels
*Attorney, Agent, or Firm*—Anthony J. Casella; Gerald E. Hespos; Ludomir A. Budzyn

[57] ABSTRACT

The invention is designed to reduce a production cost by reducing the number of operation steps during assemblage. Female terminal fittings 13 connected with coated wires 12 are inserted into a connector housing 11, and are prevented from coming out of the connector housing 11 by engagement with elastic engaging members 17. First and second locking projections 21, 22 project from each of the upper and lower wall surfaces of the connector housing 11. On the other hand, the cover 23 is formed with an engaging frame 25 engageable with the first and second locking projections 21, 22 of the connector housing 11. A joint terminal 28 is integrally mounted in the cover 23 by means of insert molding. Insufficient insertion detecting members 30 can enter deformation permitting spaces 20 for the elastic engaging members 17 of the connector housing 11.

10 Claims, 10 Drawing Sheets

CONNECTOR AND COVER THEREFOR

BACKGROUND OF THE INVENTION

1. Field of the Invention

The present invention relates to a connector, in particular a joint connector, and a cover therefor, and is particularly designed to rationalize assemblage of the joint connector.

2. Description of the Prior Art

The following joint connector is known. A plurality of terminal fittings are inserted into terminal cavities formed in a female connector housing, and are locked by elastic engaging members (lances) integrally formed with the female connector housing. On the other hand, after the terminal fittings are mounted in the connector housing, a cover is fitted on the leading end of the female connector housing. The cover includes a housing fitted with a joint terminal. By fitting the housing of the cover on the female connector housing, male terminal portions of the joint terminal are connected with the terminal fittings of the female connector housing.

The thus constructed joint connector is assembled as follows. After all terminal fittings are mounted in the female connector housing, a retainer is mounted on the female connector housing, thereby completing a female connector. Subsequently, after the joint terminal is fixedly mounted in the cover, the completed female connector and the cover are engaged with each other by hand. This assemblage requires many steps and, therefore, makes a production cost considerably high.

In view of the above problem, it is an object of the invention to provide a connector and a cover therefor which can be produced at a reduced cost by reducing the number of steps during the assemblage.

SUMMARY OF THE INVENTION

According to the invention there is provided a connector, comprising: a connector housing formed with a plurality of terminal cavities for housing terminal fittings, a cover fittable on an end of the connector housing, where connection ends of the terminal fittings are arrangeable, and a locking mechanism for holding the cover in a first mount position, corresponding in particular to a partial mount position, where the cover is at least partly engaged with an end of the connector housing and in a second mount position, corresponding in particular to a full mount position, where the cover is more deeply engaged with the connector housing than in the first mount position.

According to a preferred embodiment, a terminal means is mountable in the cover so as to project toward the connector housing, when the cover is engaged with the end of the connector housing, wherein the terminal means preferably is out of contact with the terminal fittings, when the cover is in its first mount position, while it is connectable with the terminal fittings, when the cover is on the way to the second mount position, in particular not reaching it.

Preferably, the connector housing is formed with an elastic engaging member which is elastically displaced in a first direction by, for example deformation, when the terminal fittings are inserted into the terminal cavities, thereby permitting further entry of the terminal fittings. The elastic engaging member then may be displaced in a second direction opposite to the first direction to return to its original position, when the terminal fittings are inserted to their proper positions to thereby engage the terminal fittings. The elastic engaging member preferably is elastically displaced in the first direction into a deformation permitting space when the terminal fittings are inserted into the terminal cavities. The cover is formed with an insufficient insertion detecting member which is intended to project into the deformation permitting space, when the cover is engaged with the end of the connector housing, such as in the second mount position. The insufficient insertion detecting member most preferably abuts against the deformed elastic engaging member of the connector housing when the terminal fittings are not inserted to their proper positions and the cover is engaged with the connector housing in the first or preferably in its second mount position.

The locking mechanism may comprise at least one first locking projection and at least one second locking projection which project from at least one side wall of the connector housing and/or of the cover and are spaced apart along a fitting direction of the cover by a specified distance. The locking mechanism most preferably comprises at least one engaging frame formed on the cover and/or on the connector housing so as to be elastically deformable. An engaging hole may be formed in the engaging frame. The cover may be held in its first mount position by the engagement of the first locking projection with the engaging frame. The first locking projection may project into the engaging hole, and may be held in its second mount position by the engagement of the second locking projection with the engaging frame. Thus the second locking projection may project in particular into the engaging hole.

According to a further preferred embodiment, the terminal fittings are arrangeable in the first mount position whereas they are not arrangeable in the second mount position.

According to the invention there is further provided a cover for a connector. The cover is fittable on a female connector in which a plurality of female terminal fittings are lockingly houseable in a connector housing. The cover comprises a main body fittable on an end of the connector housing, and a locking portion formed on the cover main body for holding the cover main body in a first mount position, corresponding to a partial mount position, where the cover main body is at least partly engaged with the end of the connector housing, and in a second mount position, corresponding to a full mount position, where the cover main body is more deeply engaged with the connector housing than in the first mount position.

According to a preferred embodiment, the cover further comprises a terminal means, which is a joint terminal, mountable on or in the cover so as to project toward the connector housing when the cover is engaged with the end of the connector housing. The terminal means is connected with the terminal fittings, when the cover is in its second mount position, to establish a common connection between the terminal fittings.

According to a preferred embodiment of the invention, there is provided a joint connector comprising a connector housing formed with a plurality of terminal cavities for housing terminal fittings. Terminal fittings are housed in the terminal cavities of the connector housing. A cover is fittable on an end of the connector housing where connection ends of the terminal fittings are located. A locking mechanism is provided for holding the cover in a partial mount position where the cover is engaged with the end of the connector housing and in a full mount position where the cover is more deeply engaged with the connector housing than in the partial mount position. A joint terminal is mounted in the inner surface of the cover so as to project toward the connector housing. The joint terminal is out of contact with the terminal fittings when the cover is in its partial mount position, and is connected with the terminal fittings to establish a common connection between the terminal fittings when the cover is in its full mount position.

The above joint connector is assembled as follows. The cover is held in its partial mount position on the connector housing in order to make them into a single unit. Thereafter, the single units are conveyed to a location where the terminal fittings are inserted. At this stage, after the terminal fittings are inserted into the terminal cavities of the connector housing, the cover is pressed to its full mount position. As a result, the joint terminal mounted in the cover is connected with the terminal fittings to establish a common connection between the terminal fittings, thereby completing assemblage of the joint connector.

As described above, the terminal inserting step can be performed after the cover is fitted on the connector housing to make them into a single unit. Accordingly, a series of operations from the insertion of the terminal fittings to the mounting of the cover in its full mount position can be smoothly performed. Thus, the number of operation steps can be reduced, contributing to a considerable reduction in a production cost.

The connector housing may be formed with an elastic engaging member which is elastically deformed when the terminal fittings are inserted into the terminal cavities, thereby permitting further entry of the terminal fittings. The elastic engaging member returns to its original position when the terminal fittings are inserted to their proper positions to thereby engage the terminal fittings. The cover may be formed with an insufficient insertion detecting member which projects toward the connector housing and comes into contact with the deformed elastic engaging member of the connector housing when the cover is fitted.

Accordingly, the elastic engaging member of the connector housing prevents the terminal fittings from coming out of the terminal cavities. As the terminal fittings are inserted into the terminal cavities, the elastic engaging member is elastically deformed to permit further entry of the terminal fittings. When the terminal fittings reach their proper positions, the elastic engaging member returns to its original position to engage the terminal fittings. Unless the terminal fittings reach their proper positions, the elastic engaging member remains elastically deformed and, therefore, cannot return to its original position.

When the cover is pressed to its full mount position after the respective terminal fittings are inserted, the joint terminal in the cover is connected with the terminal fittings to establish a common connection between the terminal fittings, and the insufficient insertion detecting member reaches a position where it obstructs an elastic deformation of the elastic engaging member, thereby more securely fixing the terminal fittings. If the elastic engaging member should remain elastically deformed due to the insufficient insertion of the terminal fittings, the insufficient insertion detecting member comes into contact with the elastic engaging member when the cover is pressed to its full mount position, thereby preventing further entry of the terminal fittings. In this way, the insufficient insertion of the terminal fittings can be detected.

Thus, since the cover is formed with the insufficient insertion detecting member, the insufficient insertion of the terminal fittings can be securely detected when the cover is pressed to its full mount position.

Further, the locking mechanism may preferably comprise first and second locking projections which project from a side wall of the connector housing and are spaced apart along a fitting direction of the cover by a specified distance, and an engaging frame integrally formed with the cover so as to be elastically deformable, an engaging hole being formed in the engaging frame. Then, the cover is held in its partial mount position by fitting the first locking projection in the engaging hole of the engaging frame so that the engaging frame is located between the first and second locking projections, and in its full mount position by fitting both first and second locking projections in the engaging hole.

Accordingly, when the cover is set in its partial mount position, the first locking projection is located in the engaging hole of the engaging frame and the second locking projection is located outside the engaging hole with the engaging frame between the first and second locking projections. When the cover is set in its full mount position, the first and second locking projections are located in the engaging hole, thereby perfectly preventing disengagement of the cover from the connector housing.

Thus, a combination of the engaging frame and the engaging projections enables the cover to be selectively held in its partial and full mount positions, and to securely remain held in these positions.

According to a further preferred embodiment of the invention there is provided a cover for a joint connector to be fittable on a female connector in which a plurality of female terminal fittings are lockingly housed in a connector housing. A cover main body is fittable on an end of the connector housing where connection ends of the terminal fittings are located. A locking portion is formed on the cover main body for holding the main body in a partial mount position where the cover main body is engaged with the end of the connector housing, and in a full mount position where the cover main body is more deeply engaged with the connector housing than in the partial mount position. A joint terminal is mounted in the inner surface of the cover so as to project toward the connector housing. The joint terminal is connected with the terminal fittings to establish a common connection between the terminal fittings when the cover is in its full mount position.

The above cover and the joint connector are assembled as follows. The cover is held in its partial mount position on the connector housing in order to make them into a single unit. Thereafter, the single units are conveyed to a location where the terminal fittings are inserted. At this stage, after the terminal fittings are inserted into the terminal cavities of the connector housing, the cover is pressed to its full mount position. As a result, the joint terminal mounted in the cover are connected with the terminal fittings to establish a common connection between the terminal fittings, thereby completing assemblage of the joint connector.

As described above, the terminal inserting step can be performed after the cover is fitted on the connector housing to make them into a single unit. Accordingly, a series of operations from the insertion of the terminal fittings to the mounting of the cover in its full mount position can be smoothly performed. Thus, the number of operation steps can be reduced, contributing to a considerable reduction in a production cost.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

Figure 1:
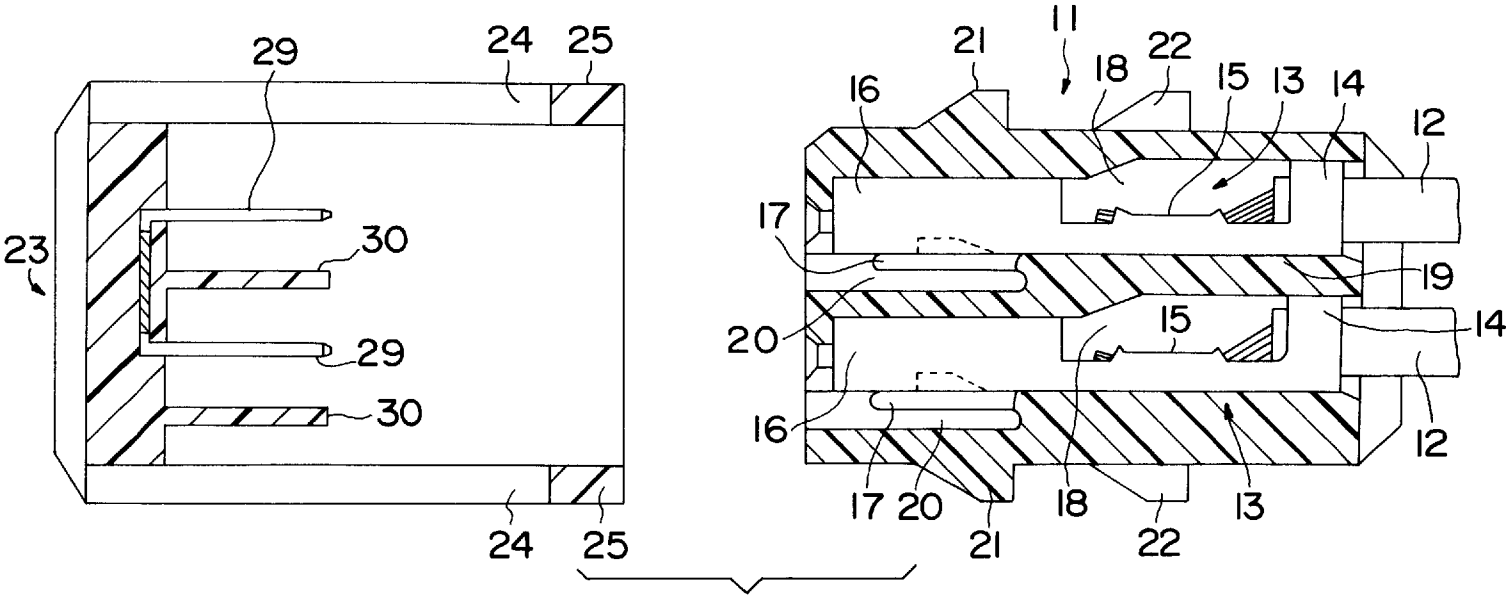
FIG. 1 is a section of a first embodiment of the invention with a cover separated from a connector housing.
Figure 2:
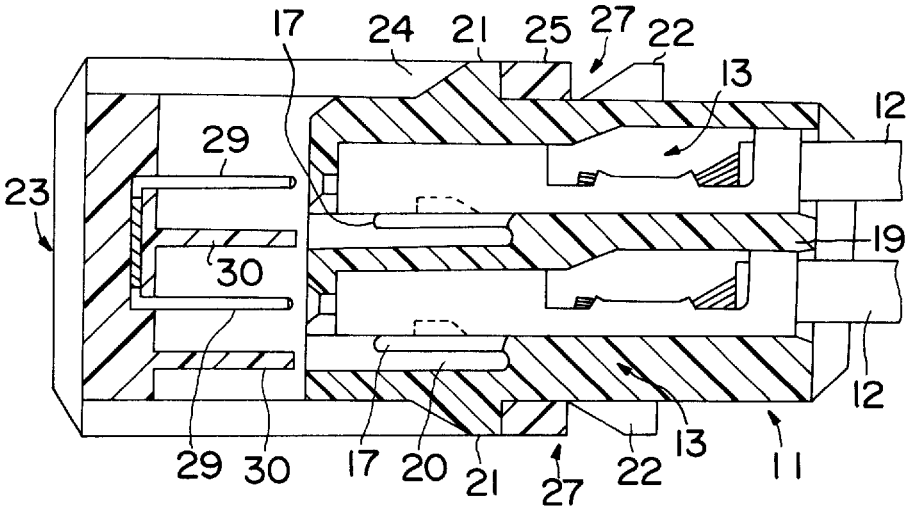
FIG. 2 is a section of the first embodiment when the cover is in its partial mount position.
Figure 3A:
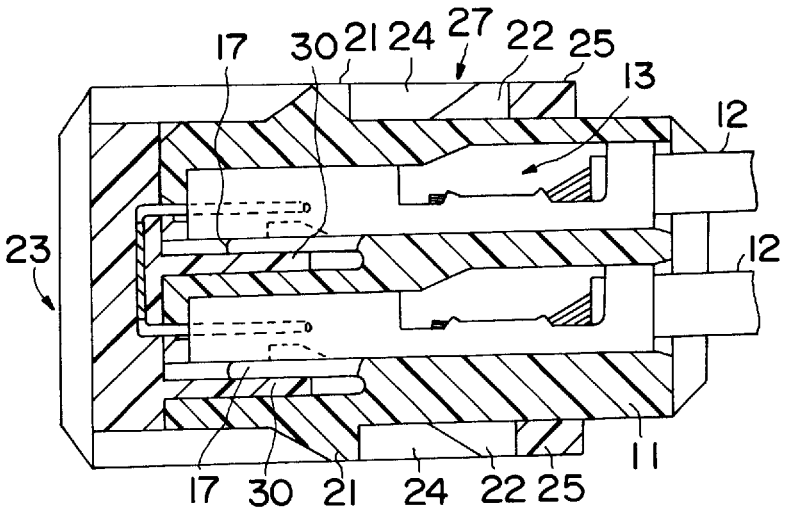
FIG. 3(A) is a section of the first embodiment when the cover is in its full mount position and the terminal fittings are arranged or inserted in the terminal cavities.
Figure 3B:
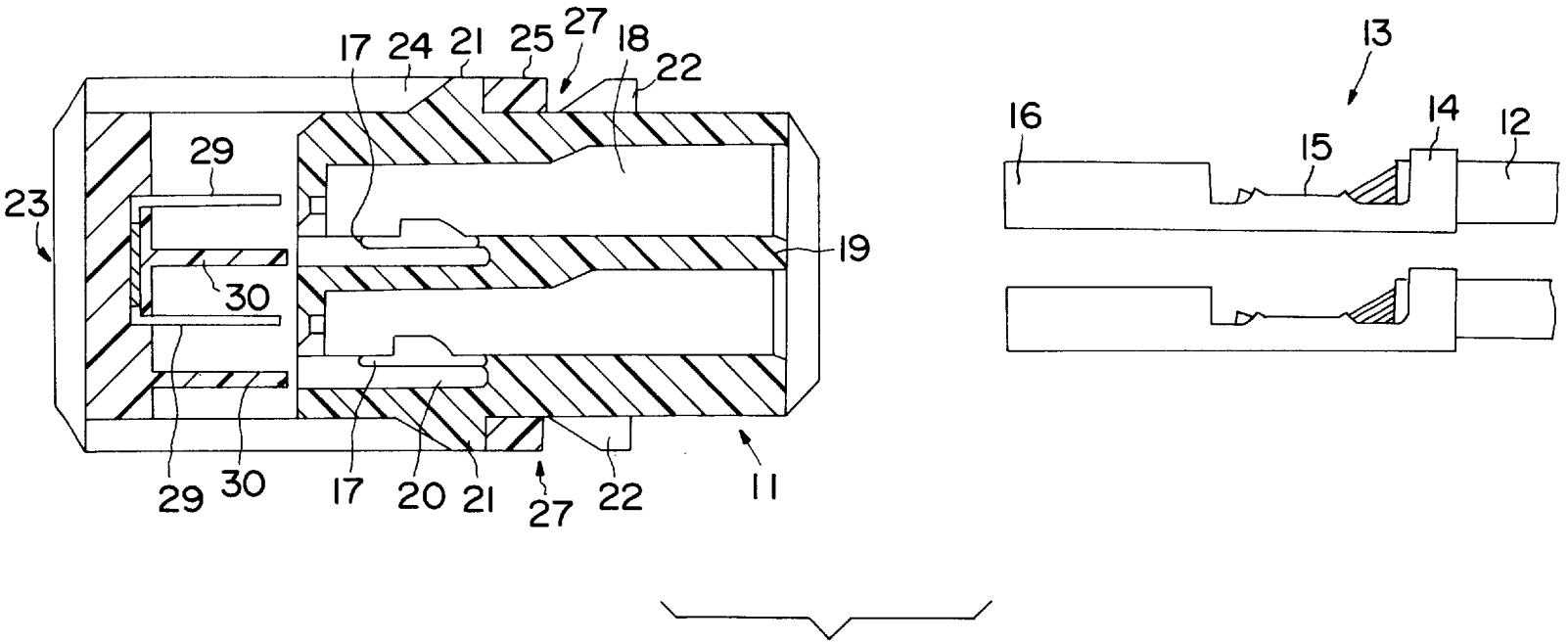
FIG. 3(B) is a section of the first embodiment when the cover is in its full mount position and the terminal fittings are withdrawn or not inserted in the terminal cavities.

Hereafter, a first embodiment of the invention is described with reference to FIGS. 1 to 6.

In these FIGURES, identified by 11 is a female connector housing into which female terminal fittings 13 connected with the leading ends of insulated or coated wires 12 are inserted. No detailed description is given to the terminal fittings 13 since they have substantially the same construction as prior art terminal fittings. Each terminal fitting 13 includes an insulation barrel 14 at its rear end, a wire barrel 15 in proximity of, in particular before the insulation barrel 14, and a hollow rectangular connection cylinder portion 16 in proximity of, in particular before the wire barrel 15. The leading ends of sheaths of the wires 12 are securely connected with the insulation barrels 14. Cores of the wires 12 are securely connected with the wire barrels 15. Though not shown in detail, an opening is formed in the bottom wall of each cylinder portion 16. Elastic engaging members 17 to be described later are engaged with the corresponding openings to thereby lock the terminal fittings 13.

The connector housing 11 is integrally or unitarily formed of synthetic resin and has a substantially rectangular boxlike shape. A plurality of terminal cavities 18 for housing the above-described terminal fittings 13 are formed in the connector housing 11. In this embodiment, for example, a total of 14 terminal cavities are formed in two stages, i.e. seven cavities for each stage. The respective terminal cavities 18 are separated from the neighboring ones like a lattice or matrix or grid by a partition wall 19, and their front and rear ends are open.

At the bottom of each terminal cavity 18, a downward deformable elastic engaging member 17 extends forward (to the left in the respective FIGURES) from a middle position of the bottom wall of the terminal cavity 18 as a support. A deformation permitting space 20 is formed below the leading end of each elastic engaging member 17. The leading end of the elastic engaging member 17 normally projects into the corresponding terminal cavity 18 (projects upward). Being pressed by the terminal fitting 13 as it is inserted into the terminal cavity 18, the elastic engaging member 17 is deformed downward, thereby permitting entry of the terminal fitting 13. When the terminal fitting 13 reaches a proper position and aforementioned opening is in conformity with the elastic engaging member 17, the elastic engaging member 17 elastically returns its original position, thereby being engaged with the opening and securing the terminal fitting 13 in the respective terminal cavity 18.

On each of upper and lower wall surfaces of the connector housing 11, there are formed one or more first locking projections 21 and one or more, in particular two second locking projections 22. The first locking projections 21 are formed in the vicinity of the leading end of the connector housing 11, and the second locking projections 22 are spaced apart from the first locking projection 21 by a specified distance to the right in the respective FIGURES. A slanted face is formed in the front portion of each locking projection is a slanted face.

Figure 4:
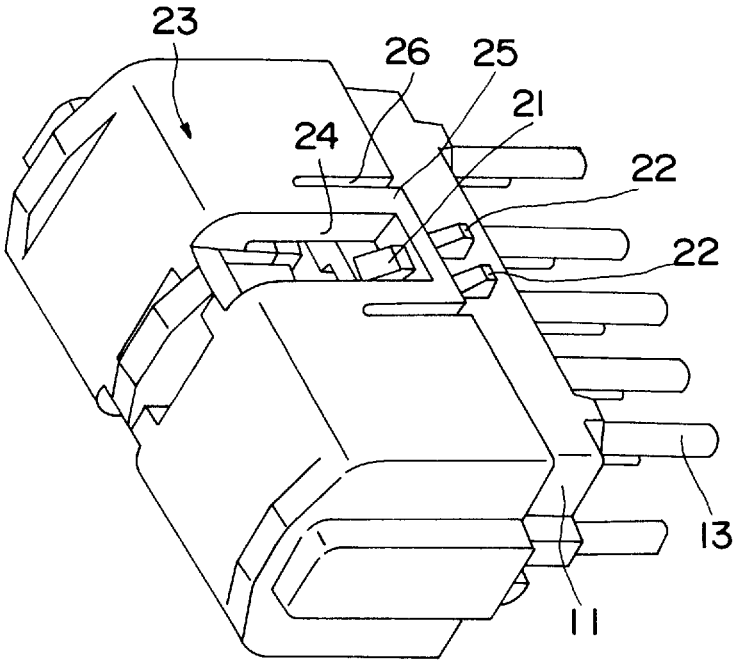
FIG. 4 is a perspective view showing a locking mechanism.

On the other hand, a cover 23 fittable on the leading end of the connector housing 11 is disposed in front of the connector housing 11. The cover 23 is also integrally formed of synthetic resin. A cover main body 23*a* is a substantially rectangular container fittable on the connector housing 11. The cover 23 is integrally or unitarily formed with a substantially rectangular engaging frame 25 formed with an engaging hole 24 in each of its upper and lower walls. Slits 26, as shown in FIG. 4, are formed on the opposite sides of each engaging frame 25, so that the engaging frame 25 is at least partially elastically deformable with respect to the cover main body 23*a*. Together with the first and second locking projections 21, 22 of the connector housing 11, the engaging frames 25 form a locking mechanism 27 for lockingly engaging the cover main body 23*a* with the connector housing 11. Accordingly, the cover main body 23*a* can be held in a first, in particular partial mount position where the first locking projections 21 are located in the engaging holes 24 of the engaging frames 25, and the engaging frames 25 are located between the first and second locking projections 21 and 22, and in a second, in particular full mount position where the first and second locking projections are located in the engaging holes 24 and the connector housing 11 is more deeply inserted into the cover main body 23*a* than in the partial mount position.

Figure 5:
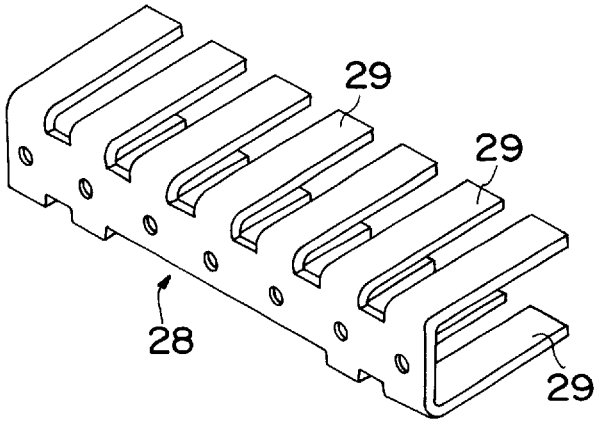
FIG. 5 is a perspective view of a joint terminal.

A joint terminal 28 shown in FIG. 5 is integrally mounted in the cover 23 e.g. by means of insert molding. The joint terminal 28 is formed by bending a metal plate and includes a total of 14 tab portions 29 arranged in two horizontal rows such that they are insertable into the connection cylinder portions 16 of the terminal fittings 13. The joint terminal 28 is fixed to the cover 23 such that the tab portions 29 project toward the respective terminal fittings 13 in the connector housing 11. A projection length of the tab portions 29 is set such that the tab portions 29 are located outside the terminal fittings 13 when the cover 23 is in its partial mount position, while being located in the cylinder portions 16 of the terminal fittings 13 when the cover 23 is in its full mount position.

Insufficient insertion detecting members 30 projecting toward the connector housing 11 are integrally or unitarily formed on the inner surface of the cover main body 23*a* so as to conform to the respective terminal cavities 18 of the connector housing 11. There are formed a total of 14 detecting members 30 in two rows, its number corresponding to the number of terminal fittings 13. The leading ends of the detecting members 30 can enter the deformation permitting space 20 of the respective terminal cavities 18.

Next, how the joint connector according to this embodiment is assembled is described. First, the cover 23 is fitted on the connector housing 11 such that the engaging frames 25 are located between the first and second locking projections 21 and 22, i.e. the cover 23 is located in its partial mount position. At this stage, the cover 23 is fixed to the connector housing 11 and, accordingly, the cover 23 and the connector housing 11 can be handled as a single unit. Since a wide open front end of the connector housing 11 is closed by the cover 23, entry of extraneous matters into the connector housing 11 can be effectively prevented.

Subsequently, the terminal fittings 13 connected with the wires 12 are inserted into the respective terminal cavities 18 of the connector housing 11. As the terminal fittings 13 are inserted, the engaging members 17 of the connector housing 11 are elastically deformed, thereby entering the deformation permitting spaces 20. When the terminal fittings 13 reach their proper positions, the engaging members 17 elastically return to their original positions. As a result, the engaging members 17 are engaged with the openings formed in the terminal fittings 13, thereby preventing the terminal fittings 13 from coming out of the cavities 18.

After all the terminal fittings 13 are inserted, the cover 23 is pressed to its full mount position. Thereby, the tab portions 29 of the joint terminal 28 are inserted into the connection cylinder portions 16 of the terminal fittings 13, thereby establishing a common connection between the terminal fittings 13. Simultaneously, the detecting members 30 of the cover 23 enter the deformation permitting spaces 20 of the connector housing 11. Therefore, the engaging members 17 are prevented from being deformed and projecting into the spaces 20. As a result, the engaging members 17 more securely prevent the terminal fittings 13 from coming out of the cavities 18.

Figure 6:
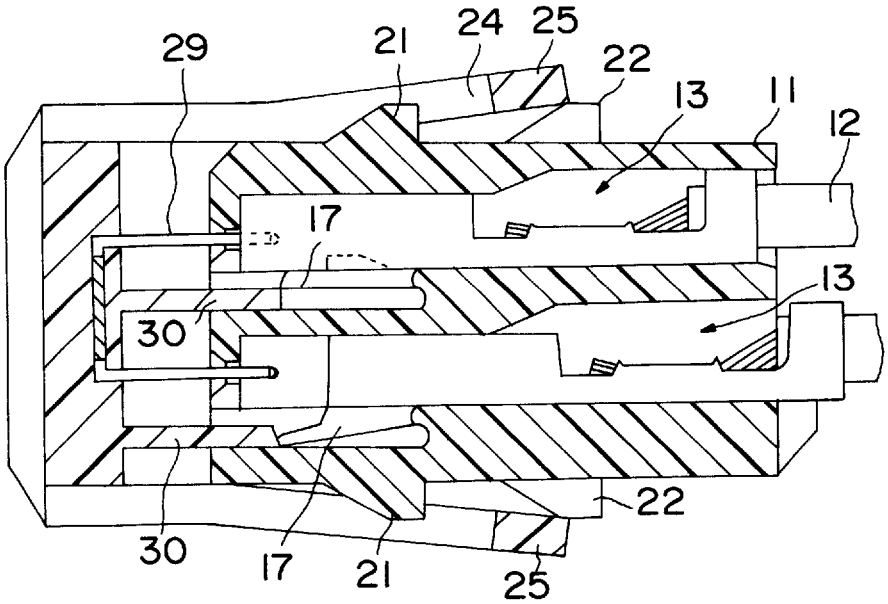
FIG. 6 is an enlarged section showing a function of an insufficient insertion detecting member.

If the terminal fittings 13 are short of their proper positions, i.e. insufficiently inserted, the engaging members 17 are still located in the deformation permitting spaces 20. Accordingly, when the cover 23 is pressed to its full mount position, the leading ends of the detecting members 30 come into contact with the engaging members 17 as shown in FIG. 6, with the result that any further entry of the terminal fittings 13 into the cavities 18 is deterred. In this way, the insufficient insertion of the terminal fittings 13 is detected. Thus, the cover 23 may be pressed to its fully mount position again after the terminal fittings 13 are pressed to their proper positions.

According to this embodiment, the terminal fittings inserting step is performed after the cover 23 is fitted on the connector housing 11 by means of the locking mechanism 27, making them into a single unit. Accordingly, a series of operations from the insertion of the terminal fittings 13 to the mounting of the cover 23 in its full mount position can be smoothly performed. Thus, the number of operation steps can be reduced not only by reduced number of parts, but also by a smooth assemblage. This contributes to a considerable reduction in a production cost.

Further, since the cover 23 is provided with the insufficient insertion detecting members 30, if the terminal fittings 13 are insufficiently inserted and, therefore, the engaging members 17 remain elastically deformed, the cover 23 cannot be pressed from its partial mount position to its full mount position. Thus, the insufficient insertion of the terminal fittings 13 can be securely detected. Further, if the cover 23 is pressed to its full mount position after the terminal fittings 13 are inserted to their proper positions, the detecting members 30 enter the deformation permitting spaces 20, thereby securely preventing the engaging members 17 from being elastically deformed. Thus, the terminal fittings 13 are securely locked in the cavities 18 by means of so-called double locking. In other words, the cover 23 which is primarily adapted to establish a common connection between the terminal fittings 13 has a function equivalent to that of an existing retainer. Therefore, the retainer which has been an essential element of the connector housing can be omitted, thereby reducing the number of parts.

FIGS. 7 to 10 show a second embodiment of the invention. The second embodiment differs from the first embodiment substantially in that the insufficient insertion detecting members and the construction of the locking mechanism are omitted.

The second embodiment is specifically described hereafter. In these FIGURES, identified by 41 is a female connector housing which is integrally or unitarily formed of synthetic resin. For example, three terminal cavities 42 are formed side by side. Female terminal fittings 44 connected with insulated or coated wires 43 are inserted into the cavities 42. The front and rear ends of each terminal cavity 42 are open. Further, at the bottom of each terminal cavity 42, a downward deformable elastic engaging member 45 extends forward (to the left in the respective FIGURES) from a middle position of the bottom wall of the terminal cavity 42 as a support. As the terminal fittings 44 are inserted, the leading ends of the engaging members 45 are pressed by the terminal fittings 44 to be deformed downward, thereby permitting further entry of the terminal fittings 44. After the terminal fittings 44 reach their proper positions, the engaging members 45 elastically return to their original positions to engage the terminal fittings 44.

On the upper wall of the connector 41, a locking arm 46 having a leading end which acts as a free end is integrally formed via a leg 46*a*. A substantially rectangular engaging hole 47 is formed at a front portion of the locking arm 46. Identified by 48 and 49 are a watertight seal and a retainer, respectively.

On the other hand, a cover 50 fittable on the leading end of the connector housing 41 is disposed in front of the connector housing 41. The cover 50 is also formed of synthetic resin. A cover main body 51 is in the form of a hood fittable on the connector housing 41. On the upper surface of the cover main body 51, there is formed an engaging frame 52 into which the locking arm 46 of the connector housing 41 is insertable. First and second locking claws 53, 54 project downward from the upper inner wall surface of the engaging frame 52. Together with the locking arm 46 of the connector housing 41, the locking claws 53, 54 form a locking mechanism 60 for lockingly engaging the cover main body 51 with the connector housing 41. Accordingly, the cover main body 51 can be held in a first, in particular partial mount position where the first locking claw 53 is engaged or interacts with or abuts on the locking arm 46 and projects into the engaging hole 47 (see FIG. 9(A)) and in a second, in particular full mount position where the second locking claw 54 is engaged with the locking arm 46 and projects into the engaging hole 47 and the connector housing 41 are more deeply inserted into the cover main body 51 than in the partial mount position (see FIG. 10).

Figure 7:
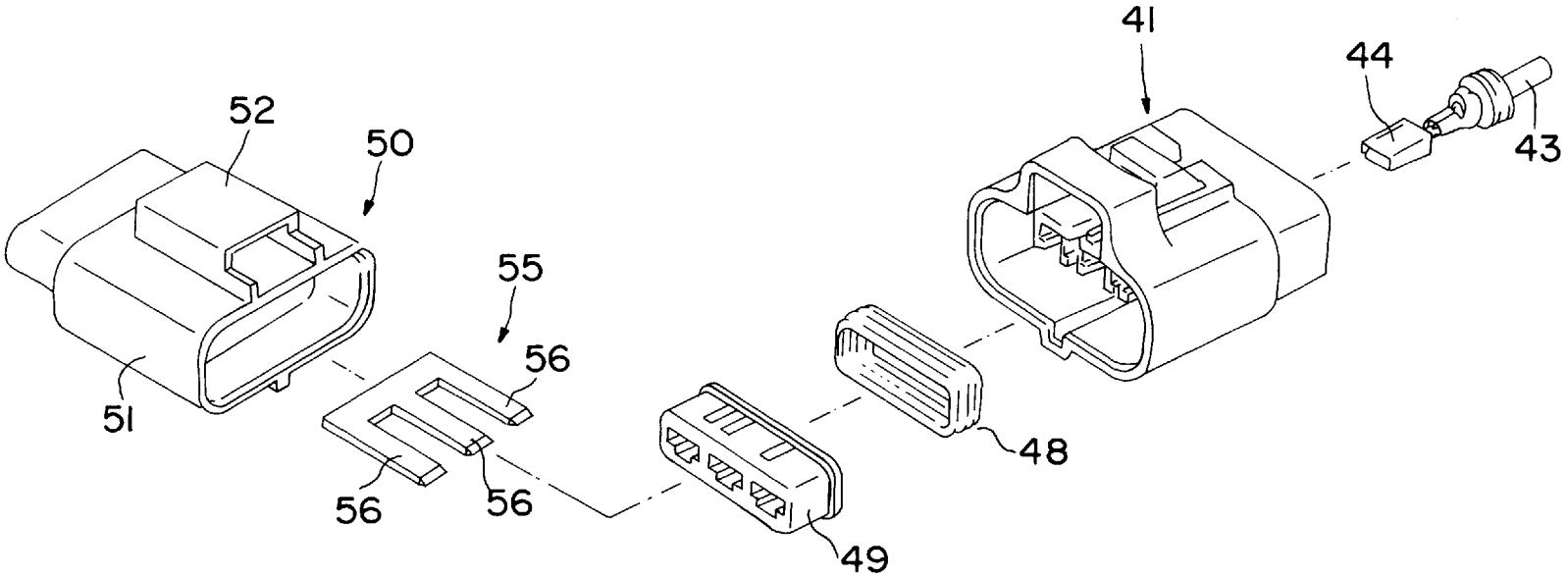
FIG. 7 is an exploded perspective view of a second embodiment of the invention.
Figure 8:
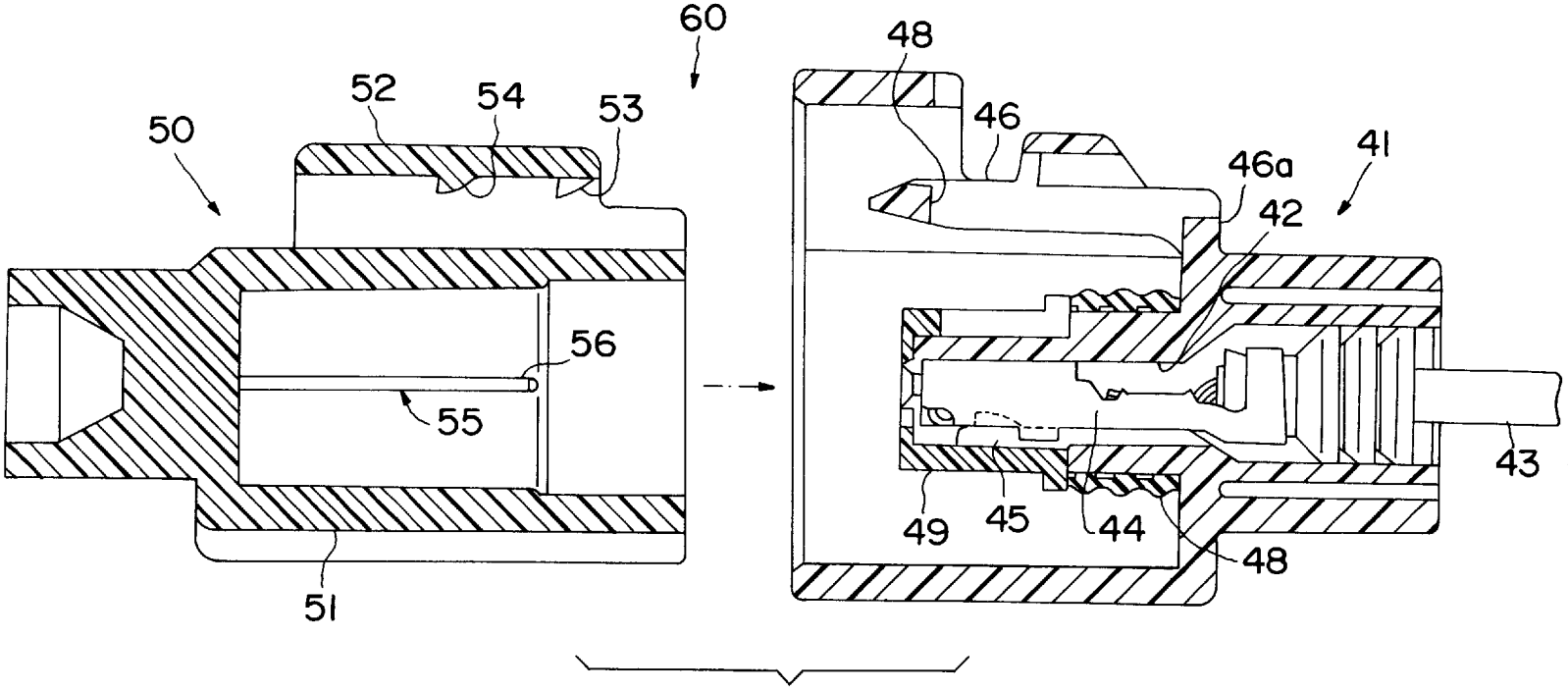
FIG. 8 is a section of male and female connectors in their separated state.
Figure 9A:
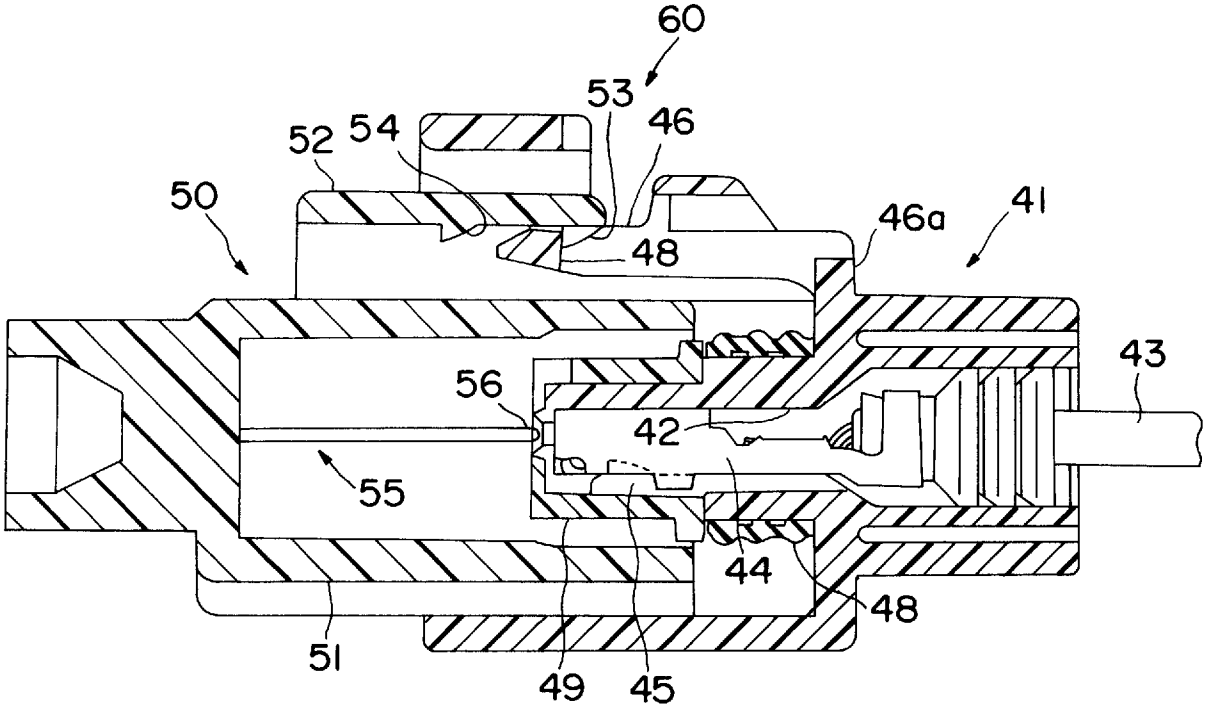
FIG. 9(A) is a section of the second embodiment when the cover is in its partial mount position and the terminal fittings are inserted or arranged in the terminal cavities.
Figure 9B:
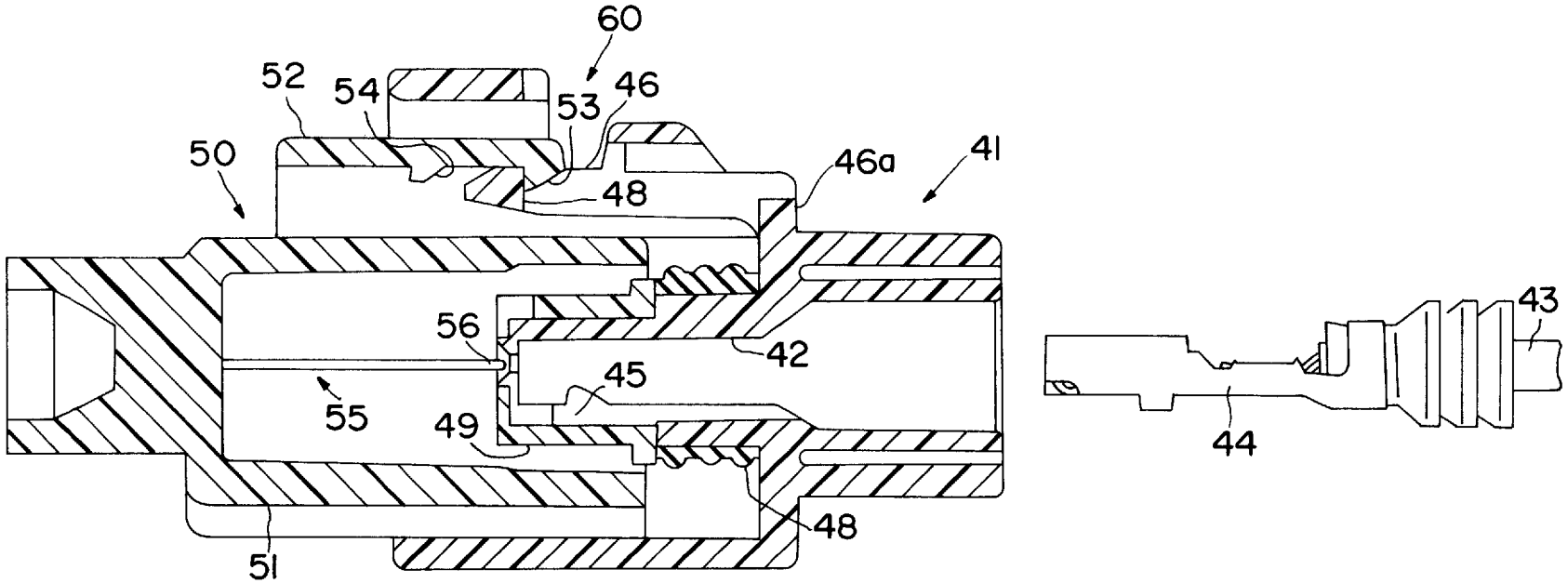
FIG. 9(B) is a section of the second embodiment when the cover is in its partial mount position and the terminal fittings are not inserted or withdrawn from the terminal cavities.
Figure 10:
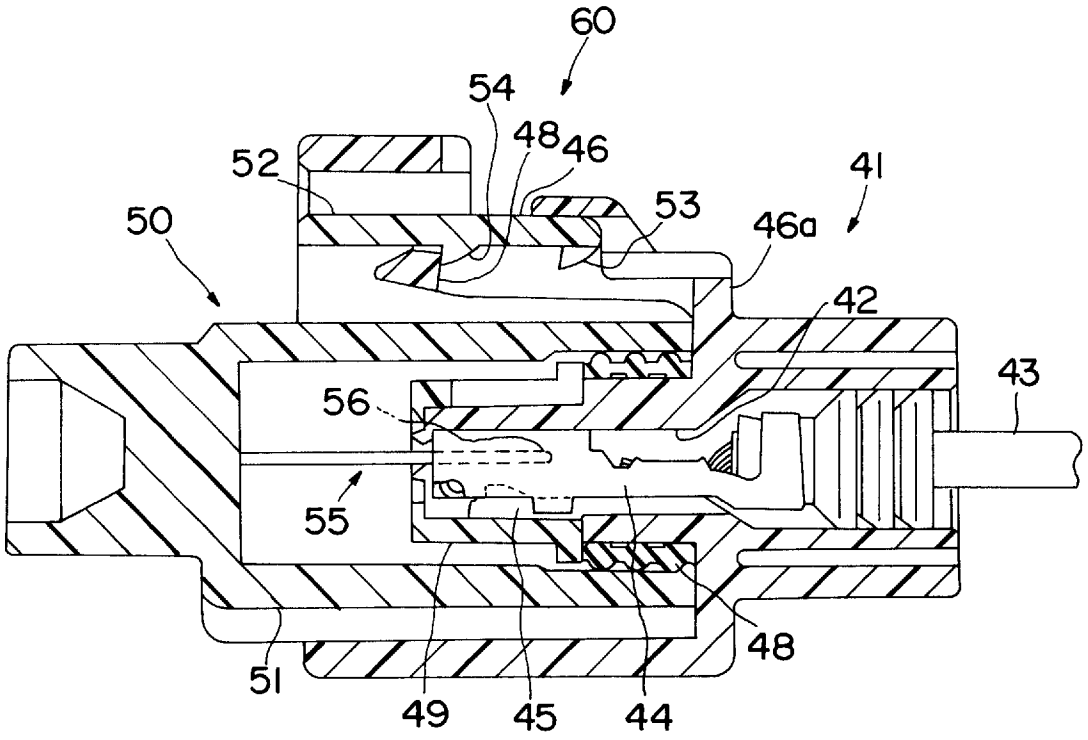
FIG. 10 is a section of the second embodiment when the cover is in its full mount position.

A joint terminal 55 shown in FIG. 7 is integrally mounted in the cover 50 e.g. by means of insert molding. The joint terminal 55 is formed by stamping, forming or bending a metal plate and includes three tab portions 56 which are arranged in a horizontal row and project such that they are insertable into the terminal fittings 44. The joint connector 55 is fixed to the cover 50 such that the tab portions 56 project toward the respective terminal fittings 44. A projection length of the tab portions 56 is set such that the tab portions 56 are located outside the terminal fittings 44 when the cover 50 is in its partial mount position, while being located in the terminal fittings 44 when the cover 50 is in its full mount position.

Next, how the joint connector according to this embodiment is assembled is described. First, the cover 50 is fitted on the connector housing 41 such that the locking arm 46 is engaged with the first locking claw 53 of the cover 50, i.e. the cover 50 is located in its partial mount position. At this stage, the cover 50 is fixed to the connector housing 41 and, accordingly, the cover 50 and the connector housing 41 can be handled as a single unit. Since a wide open front end of the connector housing 41 is closed by the cover 50, entry of extraneous matters into the connector housing 41 can be effectively prevented.

Subsequently, the terminal fittings 44 are inserted into the respective terminal cavities 42 of the connector housing 41. As the terminal fittings 44 are inserted, the engaging members 45 of the connector housing 41 are elastically deformed. When the terminal fittings 44 reach their proper positions, the engaging members 45 return to their original positions and are engaged with the openings formed in the terminal fittings 44, thereby preventing the terminal fittings 44 from coming out of the cavities 42. After all the terminal fittings 44 are inserted, the cover 50 is pressed to its full mount position. Thereby, the tab portions 56 of the joint terminal 55 are inserted into the terminal fittings 44 to establish a common connection between the terminal fittings 44.

According to this embodiment as well, the terminal fitting inserting step is performed after the cover 50 is fitted on the connector housing 41, making them into a single unit. Accordingly, a series of operations from the insertion of the terminal fittings 44 to the mounting of the cover 50 in its full mount position can be smoothly performed. Thus, the number of operation steps can be reduced not only by reduced number of parts, but also by a smooth assemblage. This contributes to a considerable reduction in a production cost.

The invention is not limited to the foregoing embodiments, but may be embodied in the following fashion. This embodiment is also embraced by the technical scope of the invention.

Although the joint terminal is mounted in the cover by means of insert molding in the foregoing embodiments, it may be pressed into the already formed cover so as to make them into a single unit. Alternatively, the joint terminal may be inserted into the cover, making them into a single unit, and a lid may be mounted on the cover to prevent the joint terminal from coming out of the cover.

The invention is not limited to the described and illustrated embodiments, and a variety of changes are possible without departing the spirit and scope of the invention as defined in the appended claims.

What is claimed is:

1. A connector, comprising:

a connector housing (11; 41) formed with a plurality of terminal cavities (18; 42) for housing terminal fittings (13; 44), elastic engaging members (17) in proximity to said respective terminal cavity (18; 42), said elastic engaging members (17) being displaceable into a deformation permitting space (20) during insertion of the respective terminal fittings (13; 44) into the terminal cavities (18) and elastically moving out of said deformation permitting space (20) upon complete insertion of the respective terminal fitting (13), a cover (23; 50) fittable on an end of the connector housing (11; 41) where connection ends of the terminal fittings (13; 44) are arrangeable, a locking mechanism (21, 22, 25; 60, 52) for holding the cover (23; 50) in a first mount position where the cover (23; 50) is at least partly engaged with an end of the connector housing (11; 41) and in a second mount position where the cover (23; 50) is more deeply engaged with the connector housing (11; 41) than in the first mount position, at least one joint terminal (28; 15) mounted in the cover (23; 50), the joint terminal (28; 15) being spaced from the terminal fittings (13; 44) when the cover (23; 50) is in the first mount position, and contacting the terminal fittings (13; 44) when the cover is in the second mount position, and an insufficient insertion detection member (30) integrally formed with the cover (23) for projection into the deformation permitting space (20) when the cover (23) is in the second mount position, said insufficient insertion detecting member (30) being blocked by any of said elastic engaging members (17) in the deformation permitting space (20), thereby preventing movement of the cover (23; 50) into the second mount position and indicating incomplete insertion of at least one said terminal fitting (13).

2. A connector according to claim 1, wherein the locking mechanism (21, 22, 25; 60, 52) comprises at least one first locking projection (21; 53) and at least one second (22; 54) locking projection which project from at least one of the connector housing (11; 41) and the cover (23; 50) and are spaced apart along a fitting direction of the cover (23; 50) by a specified distance.

3. A connector according to claim 2, wherein the locking mechanism (21, 22, 25; 60, 52) comprises at least one engaging frame (25; 52) formed on one of the cover (23; 50) and the connector housing (11; 41) so as to be elastically deformable, an engaging hole (24; 47) being formed in the engaging frame, and wherein the cover (23; 50) is held in the first mount position by engagement of the first locking projection (21; 53) with the engaging frame (23; 52), wherein the first locking projection (21; 53) projects into the engaging hole (24; 47), and is held in the second mount position by the engagement of the second locking projection (22; 54) with the engaging frame (23; 52), wherein the second locking projection (22; 54) projects into the engaging hole (24; 47).

4. A connector according to claim 1, wherein the terminal fittings (13) are insertable when the cover and the connector housing are in the first mount position whereas they are not insertable when the cover and the connector housing are in the second mount position.

5. A connector according to claim 1, wherein the cover (23; 50) is molded from a resin material, and wherein the joint terminal (28; 55) is insert molded into the cover (23; 50).

6. A connector according to claim 1, wherein the joint terminal (28; 55) is a shorting terminal unitarily formed from a conductive metal and having a base and a plurality of tab portions (29) extending from the base, the tab portions (29) projecting toward the connector housing for contacting the terminal fittings (13) when the cover (23; 50) is in the second mount position.

7. A connector according to claim 6, wherein the base of the joint terminal (28; 55) is substantially perpendicular to the tabs (29).

8. A connector according to claim 7, wherein said cover (23; 50) is unitarily molded from a resin material, and wherein the joint terminal (28; 55) is insert molded into the cover such that the base of the joint terminal (28; 55) is substantially embedded in the resin of the cover (23; 50) and such that the tabs (29) project from the resin of the cover (23; 50).

9. A connector, comprising:

a connector housing (11; 41) unitarily molded from a resin material and having opposed front and rear ends, a plurality of terminal cavities (18; 42) extending through said connector housing (11) for housing terminal fittings (13; 44), said connector housing (11; 41) having at least one external surface with a first rigid locking projection 21 in proximity to said front end of said connector housing (11; 41) and a second rigid locking projection (22) disposed between said first locking projection (21) and said rear end of said connector housing (11; 41); and a cover (23; 50) slidably mountable over the front end of the connector housing (11; 41) said cover (23; 50) having a resiliently deflectable locking mechanism disposed for engagement with said first locking projection (21) in a first sliding position of said cover (23; 50) on said connector housing (11; 41) and for locking engagement with said second locking projection (22) in a second sliding position of said cover (23; 50) on said connector housing (11; 41), said cover having a joint terminal (28; 55) securely mounted therein, said joint terminal having a plurality of tabs substantially aligned respectively with said terminal cavities (18; 42) of said connector housing (11; 41), said tabs being spaced from the terminal fittings (13; 44) when the cover (23; 50) is in said first sliding position and being connected with the terminal fittings (13; 44) when the cover (23; 50) is in the second sliding position.

10. A connector according to claim 9, wherein said connector housing further comprises elastic engaging members (17) disposed adjacent the respective terminal cavities (18), said housing (11; 41) further including a deformation permitting space for permitting deflection of each said elastic engaging member (17) during insertion of the respective terminal fittings (13; 44), each said terminal fitting (13; 44) having a locking aperture formed therein for locked engagement with said elastic engaging member (17) upon complete insertion of the respective terminal fitting (13; 44) into the respective terminal cavities (18; 42), said cover comprising at least one insufficient insertion detecting member (30) aligned with the deformation permitting space (20), said insufficient insertion detecting member (30) being blocked by any of said elastic engaging members (17) in said deformation permitting space (20), thereby preventing said cover (23; 50) from sliding into said second sliding position on said connector housing (11; 41) and indicating incomplete insertion of at least one said terminal fitting (13; 44).

* * * * *